US006059328A

United States Patent [19]

Gomi

[11] Patent Number: 6,059,328

[45] Date of Patent: May 9, 2000

[54] VEHICLE DOOR LATCH DEVICE

[75] Inventor: Yoshihito Gomi, Yamanashi-ken, Japan

[73] Assignee: Mitsui Kinzoku Kogyo Kabushiki Kaisha, Tokyo, Japan

[21] Appl. No.: 09/166,286

[22] Filed: Oct. 5, 1998

[30] Foreign Application Priority Data

| | | | |
|---|---|---|---|
| Oct. 6, 1997 | [JP] | Japan | 9-289072 |
| Oct. 9, 1997 | [JP] | Japan | 9-293253 |
| Oct. 13, 1997 | [JP] | Japan | 9-294926 |
| Oct. 27, 1997 | [JP] | Japan | 9-311519 |

[51] Int. Cl.[7] ..... E05C 3/06

[52] U.S. Cl. ..... 292/216; 292/DIG. 64; 292/DIG. 53; 292/DIG. 201

[58] Field of Search ..... 292/DIG. 64, DIG. 53, 292/169.11, DIG. 23, 216, 201

[56] References Cited

U.S. PATENT DOCUMENTS

| | | | |
|---|---|---|---|
| 4,538,845 | 9/1985 | Yamada | 292/216 |
| 4,585,261 | 4/1986 | Adams et al. | 292/216 |
| 4,948,183 | 8/1990 | Yamada | 292/199 |
| 4,968,074 | 11/1990 | Yamagishi et al. | 292/201 |
| 4,978,154 | 12/1990 | Kleefeldt et al. | 292/201 |
| 5,035,453 | 7/1991 | Fukumoto et al. | 292/336.3 |
| 5,288,115 | 2/1994 | Inoue et al. | 292/201 |
| 5,678,869 | 10/1997 | Yoshikuwa | 292/216 |

FOREIGN PATENT DOCUMENTS

| | | |
|---|---|---|
| 3-038374 | 8/1991 | Japan . |
| 6-040297 | 10/1994 | Japan . |

*Primary Examiner*—B. Dayoan
*Assistant Examiner*—John B. Walsh
*Attorney, Agent, or Firm*—Browdy and Neimark

[57] ABSTRACT

A vehicle door latch device comprises a latch body provided at a front side thereof with a recess for accommodating a latch and a ratchet, a metal front plate fixed to the front side of the latch body, a metal back plate fixed to a rear side of the latch body, a lock lever rotatably mounted on the latch body by a first shaft, an actuator for rotating the lock lever. The back plate includes a rear plate substantially parallel to the latch body and a first angled plate projecting backward from the rear plate. The front plate has a cover plate for substantially covering the recess and a second angled plate projecting backward from the cover plate. The actuator is fixed to both of the first and second angled plate.

11 Claims, 12 Drawing Sheets

1
23
62
54
75
75
60
64
9
6
3
63
17
7
2
14
12
13
20
4
11
16
8
18B
23
15
10
5
INTERIOR SIDE
EXTERIOR SIDE

FIG.10
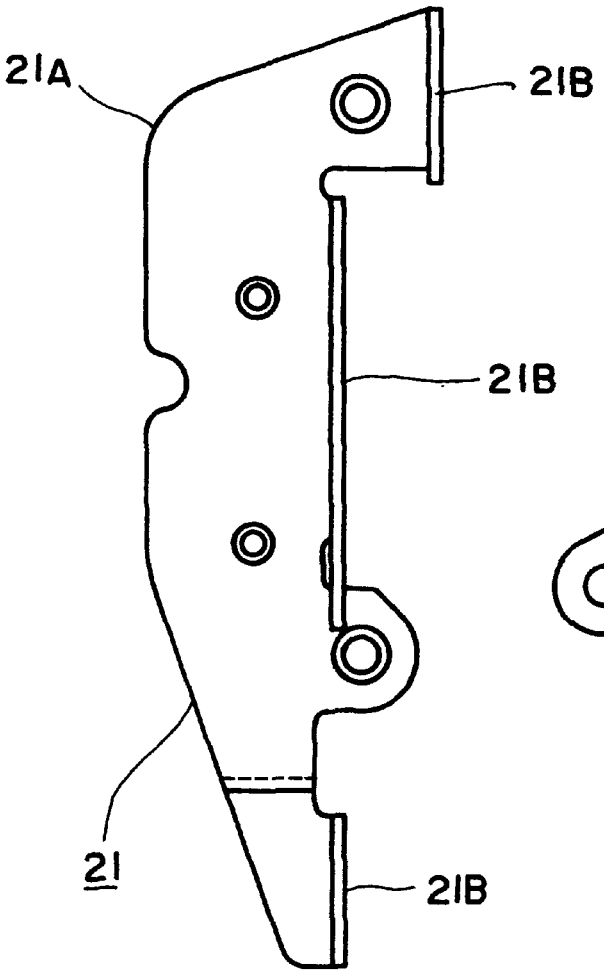
FIG.11
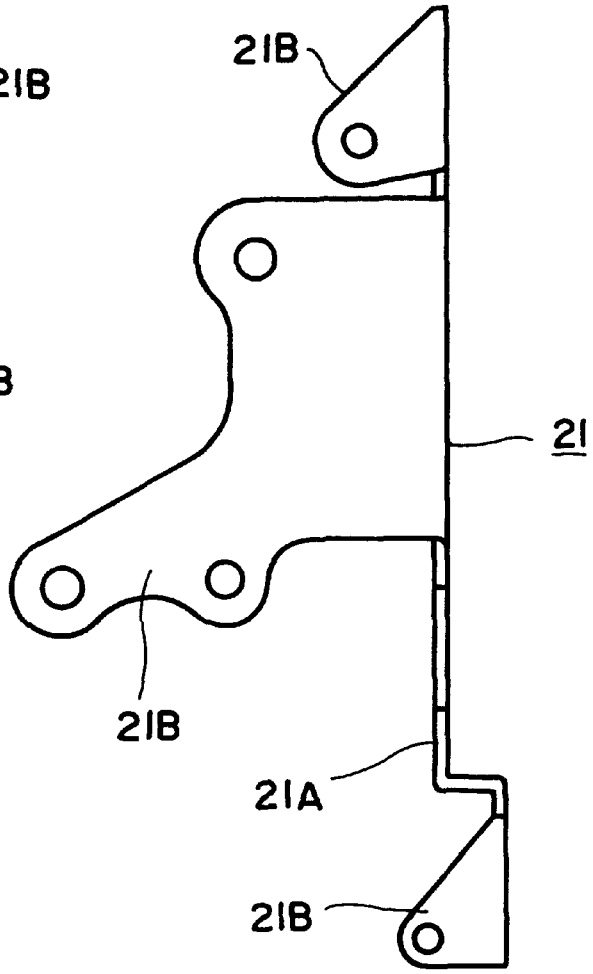
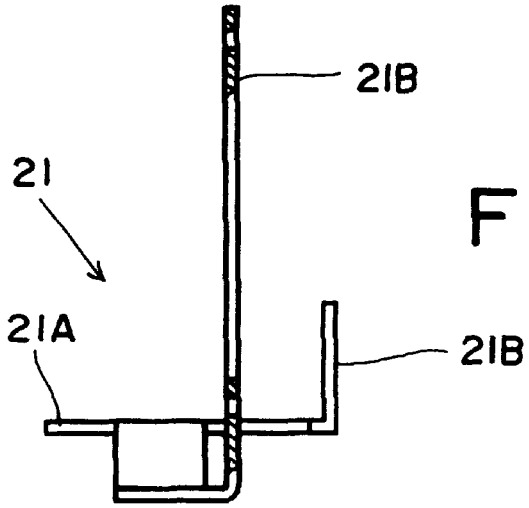
FIG.12

FIG. 13
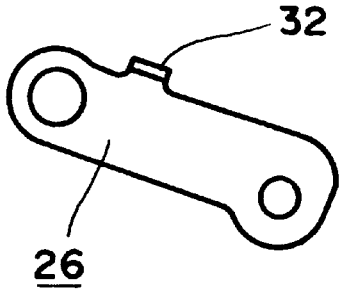
FIG. 14
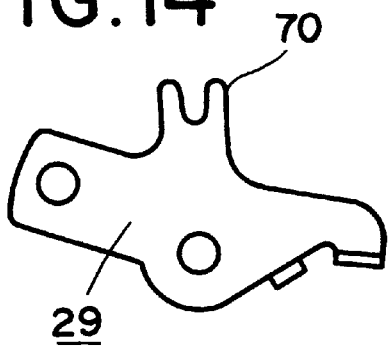
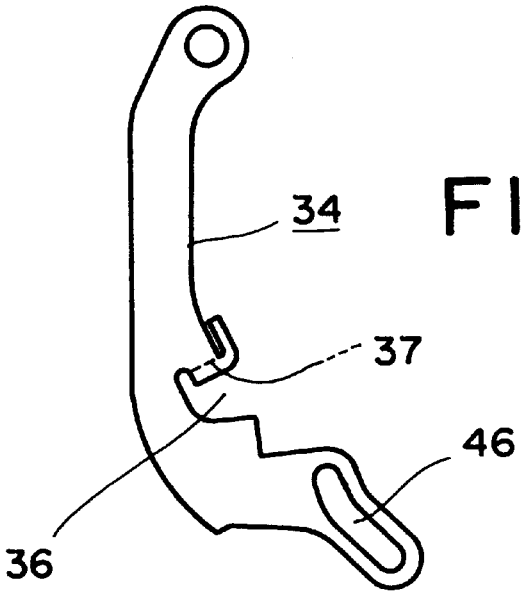
FIG. 15
FIG. 17
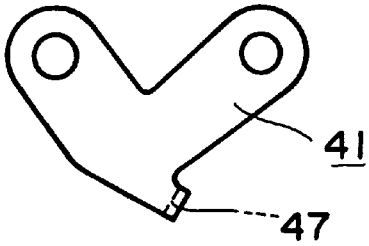
FIG. 16
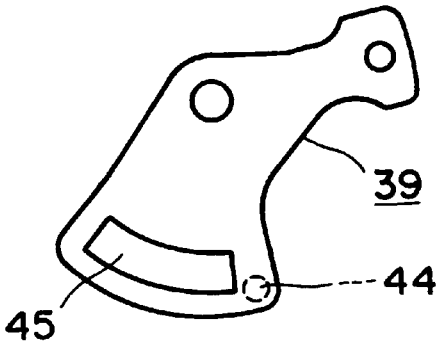

FIG. 20
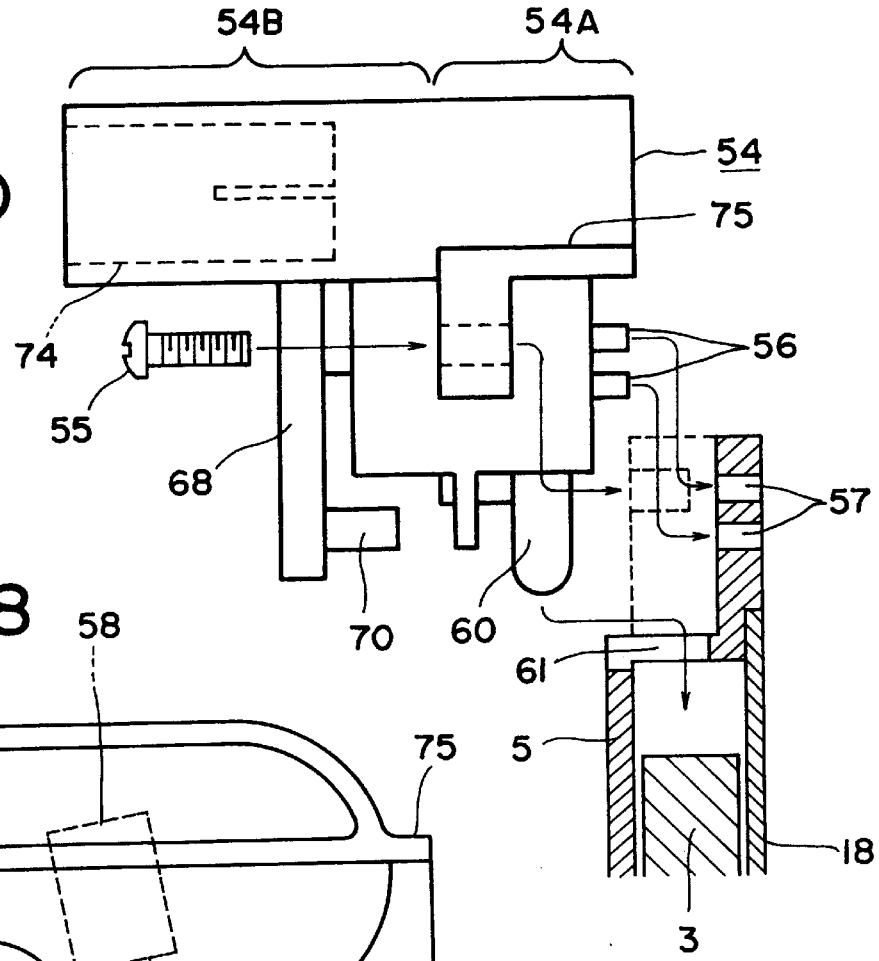
FIG. 18
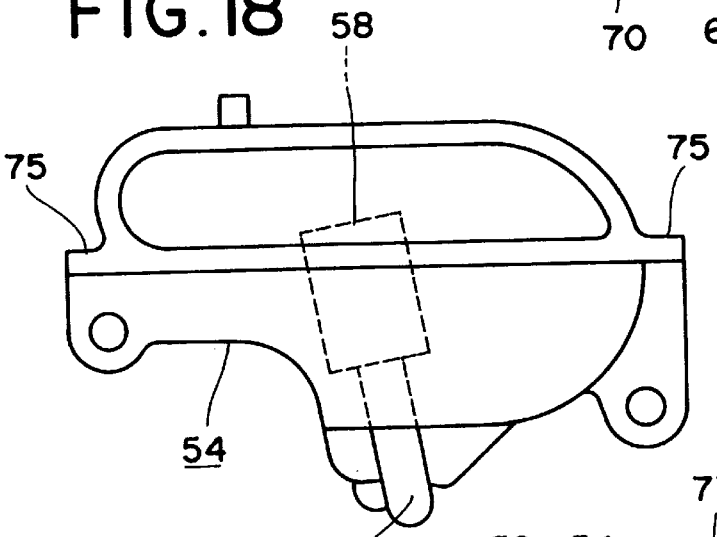
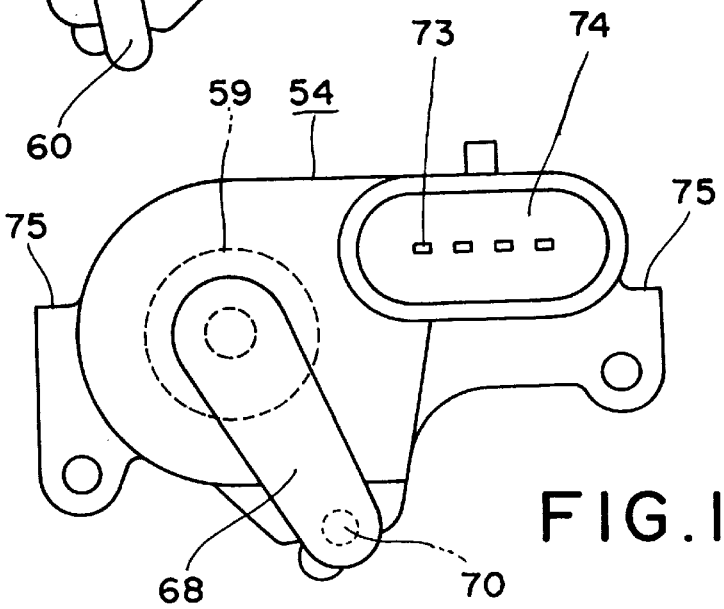
FIG. 19

VEHICLE DOOR LATCH DEVICE

BACKGROUND OF THE INVENTION

1. Field of the Invention

The present invention relates to a vehicle door latch device and relates to, in particular, a lock actuator and a switch box of the latch device.

2. Description of the Related Art

A conventional door latch device has a motorized actuator for switching the latch device into a locked state and an unlocked state. Some of the actuator is directly installed on a rear surface or a bottom of a latch body of the latch device (as disclosed in, for example, U.S. Pat. No. 4,948,183), and most of the remainder is indirectly installed at the latch body using a metal bracket (as disclosed in, for example, U.S. Pat. No. 4,978,154 and U.S. Pat. No. 5,035,453).

Although the former latch device wherein the actuator is directly installed at the latch body has an advantage in that a bracket is not necessary as the latter is, it is sometimes more expensive than the latter one. This is due to the fact that the actuator of the former is designed exclusively for a certain latch body at which the actuator is to be installed. Besides, it is substantially impossible to use the exclusively designed actuator in a different type of a latch body. Therefore the typical actuator is installed at the latch body using the metal bracket as the latter.

The latter latch device typically comprises a latch body for accommodating a latch and a ratchet, a metal front plate installed at a front surface of the latch body, and a metal back plate installed at a rear surface of the latch body. The back plate includes a rear plate having a surface substantially parallel to the rear surface of the latch body, and an angled plate projecting backward from the rear plate. The actuator is fixed to the angled plate by screws. The latter latch device is thus aimed to cut costs by forming the bracket used for installation of actuator, integrally with the back plate.

The problem with the latter latch device is that it is difficult to ensure actuator installation strength. The actuator installed at the angled plate is swung more than expected by the metal elasticity of the angle plate and sometimes make a clattering noise. Due to this, it is required to improve the strength or rigidity of installation of the actuator using a reinforcing member independent of the angled plate, thereby raising manufacturing costs.

The conventional latch device has, meanwhile, a switch for detecting a position of the latch which is adapted to be rotated against a resilient force of a latch return spring by an engagement a striker fixed to a vehicle body (as disclosed in, for example, U.S. Pat. No. 5,678,869). A signal from the switch is utilized to control an interior light or room lamp of the vehicle, an ajar warning light and/or an ignition key light for illuminating a keyway or a keyhole of an ignition key cylinder.

Japanese U.M. Publications (Kokoku) Nos. 3-38374 and 6-40297 teach a handle assembly which has a handle base installed at an exterior door panel of a vehicle door, an exterior opening handle rotatably installed at the handle base, and a switch for detecting the rotation or operation of the opening handle. A signal from the switch is utilized to control a door key light for illuminating a keyway of a door key cylinder. With this structure, the keyway is illuminated by the operation of the door handle even in a dark place and is easily visible.

The latter switch, which is installed at the handle base, is required to be assembled independently of the assembly of the latch device. It is, however, possible to store the latter switch together with the former switch in a switch box installed at the latch device.

SUMMARY OF THE INVENTION

It is therefore an object of the present invention to provide a vehicle door latch device having improved actuator installation strength by using a metal front plate which has been conventionally used for the latch device.

It is another object of the present invention to provide a vehicle door latch device wherein a switch for detecting the position of a latch and a switch for detecting the rotation of an exterior opening handle are stored in a waterproof switch box installed at a latch body.

Additional aspects, objects, advantages, and features of the present invention will become apparent from the following description and appended claims, taken in conjunction with the accompanying drawings.

BRIEF DESCRIPTION OF THE DRAWINGS

FIG. 10 is a back view of a metal back plate of the latch assembly;

FIG. 11 is a side view showing an interior side of the back plate;

FIG. 12 is a bottom view of the back plate;

FIG. 13 is a back view of an outer open lever of the latch assembly;

FIG. 14 is a back view of an inner open lever of the latch assembly;

FIG. 15 is a back view of an open link of the latch assembly;

FIG. 16 is a back view of an inner lock lever of the latch assembly;

FIG. 17 is back view of an outer lock lever of the latch assembly;

FIG. 18 is a front view of the switch box;

FIG. 19 is a back view of the switch box;

FIG. 20 is an explanatory view for installation of the switch box at latch body;

DETAILED DESCRIPTION OF THE PREFERRED EMBODIMENTS

Figure 1:
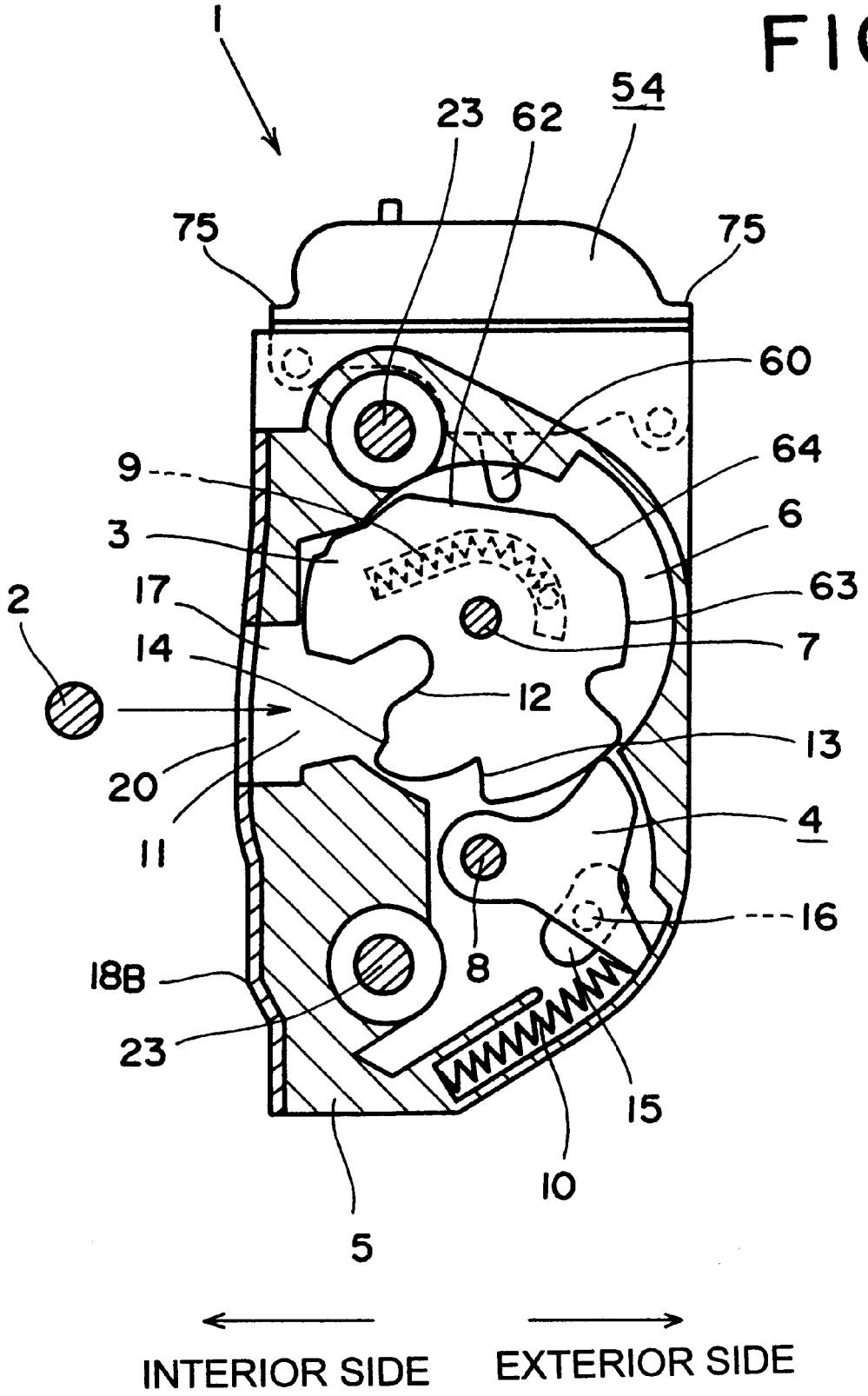
FIG. 1 is a partially longitudinal sectional front view showing an unlatched state of a latch assembly of a vehicle door latch device according to the present invention.

An embodiment of the present invention will now be described below with reference to the drawings. A vehicle door latch device according to the present invention comprises a latch assembly 1 installed at a door and a striker 2 fixed to a vehicle body (not shown). The latch assembly 1 has a latch 3 adapted to be engaged with the striker 2 when the door is closed, and a ratchet 4 for holding engagement of the latch 3 with the striker 2. The latch 3 is rotatably accommodated by a latch shaft 7 at an upper portion within a recess 6 formed on a front side of a latch body 5 made of synthetic resin and the ratchet 4 is rotatably accommodated by a ratchet shaft 8 in a lower portion within the recess 6.

Figure 2:
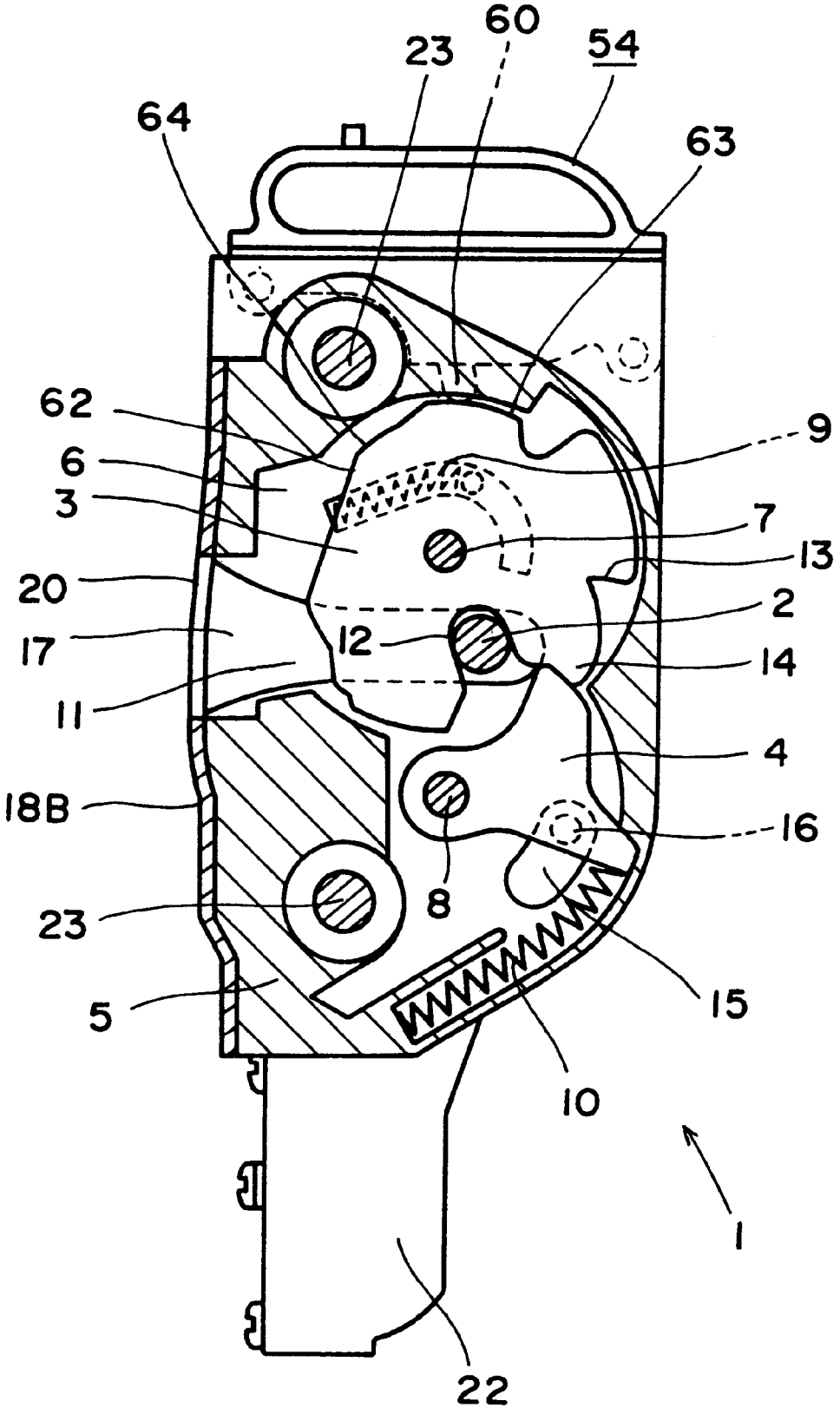
FIG. 2 is a partially longitudinal sectional front view showing a full-latched state of the latch assembly.

The latch 3 is urged clockwise in FIGS. 1 and 2 by the elasticity of a latch spring 9. When the door is in an open position, the latch 3 is held in an unlatched position shown in FIG. 1 by the elasticity of the spring 9. The ratchet 4 is urged counterclockwise by the elasticity of a ratchet spring 10. When the door is moved from the open position toward a closed position, the striker 2 enters into a horizontal passage 11 formed in the latch body 5 and contacts with a U-shaped groove 12 of the latch 3, thereby the latch 3 is rotated counterclockwise against the elasticity of the latch spring 9. When the latch 3 is rotated from the unlatched position to a half-latched position, the ratchet 4 is engaged with a first step 13 of the latch 3, and when the latch 3 comes to a full-latched position, the ratchet 4 is engaged with a second step 14 of the latch 3 (see FIG. 2), thereby the door is held in the closed position. The ratchet 4 has a ratchet pin 16 protruding to a rear side of the latch body 5 through an opening 15 formed in the latch body 5. When the pin 16 is moved downward in FIG. 2 by the operation of a door opening handle to be described later, the ratchet 4 is released from the latch 3 so as to open the door.

Interior and exterior sides of the latch assembly 1 are defined by the position of an entrance or opening 17 of the horizontal passage 11 into which the striker 2 enters when the door is closed, which entrance 17 must be formed on the interior side of the latch body 5.

Figure 8:
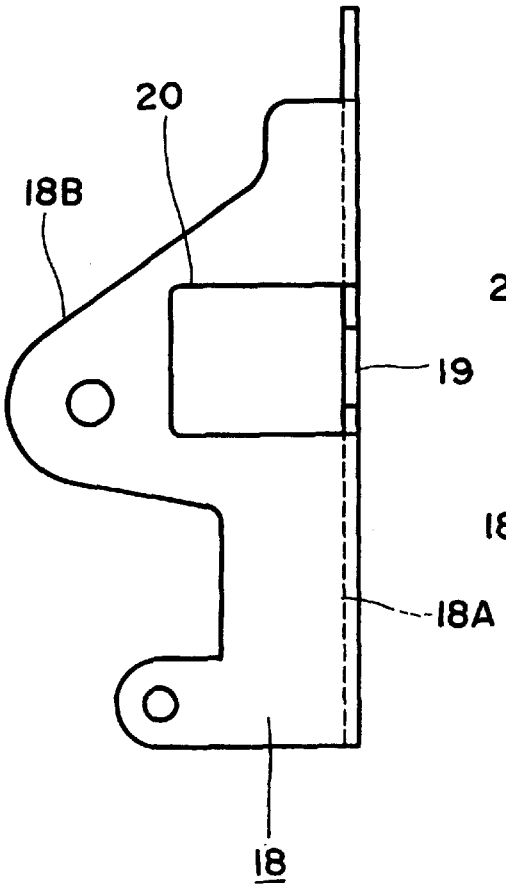
FIG. 8 is a side view showing an interior side of the front plate.
Figure 7:
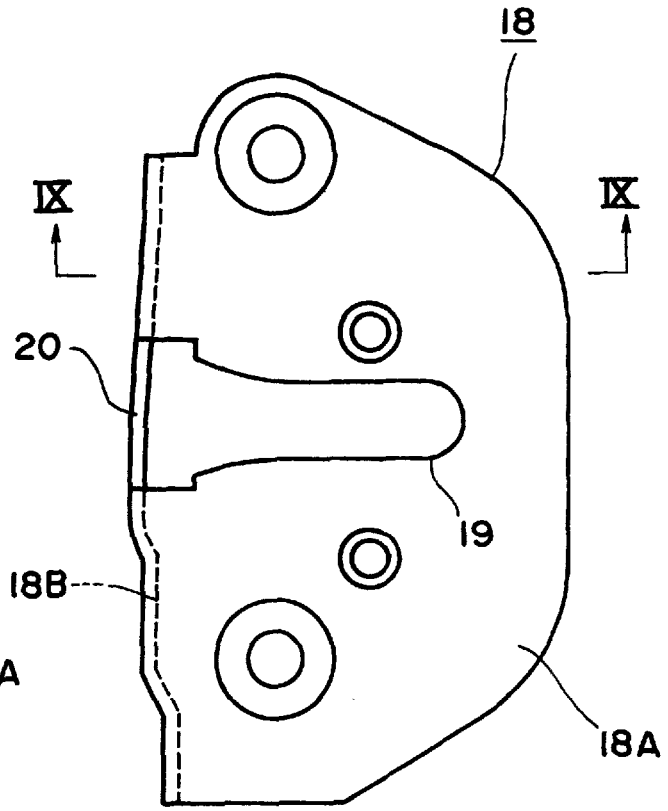
FIG. 7 a front view of a metal front plate of the latch assembly.
Figure 9:
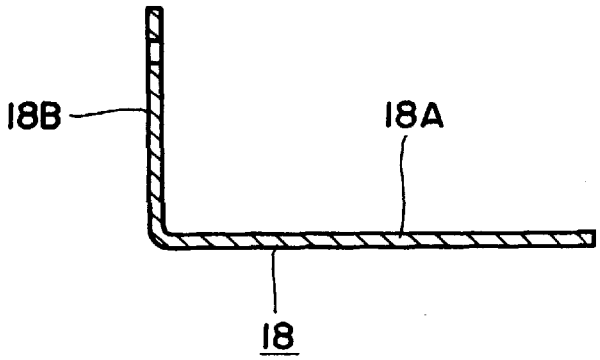
FIG. 9 is a cross-sectional view taken along line IX—IX of FIG. 7.

A metal front plate 18 shown in FIGS. 7 to 9 is attached to the front surface of the latch body 5. The front plate 18 consists of a cover plate 18A for substantially covering the recess 6 and an angled plate 18B projecting backward from an interior side edge of the cover plate 18A. The cover plate 18A has a main notch 19 corresponding to the horizontal passage 11, and the angled plate 18B has a sub notch 20 corresponding to the entrance 17. The angled plate 18B protrudes to the rear side of the latch body 5 across the interior side surface of the latch body 5.

Figure 5:
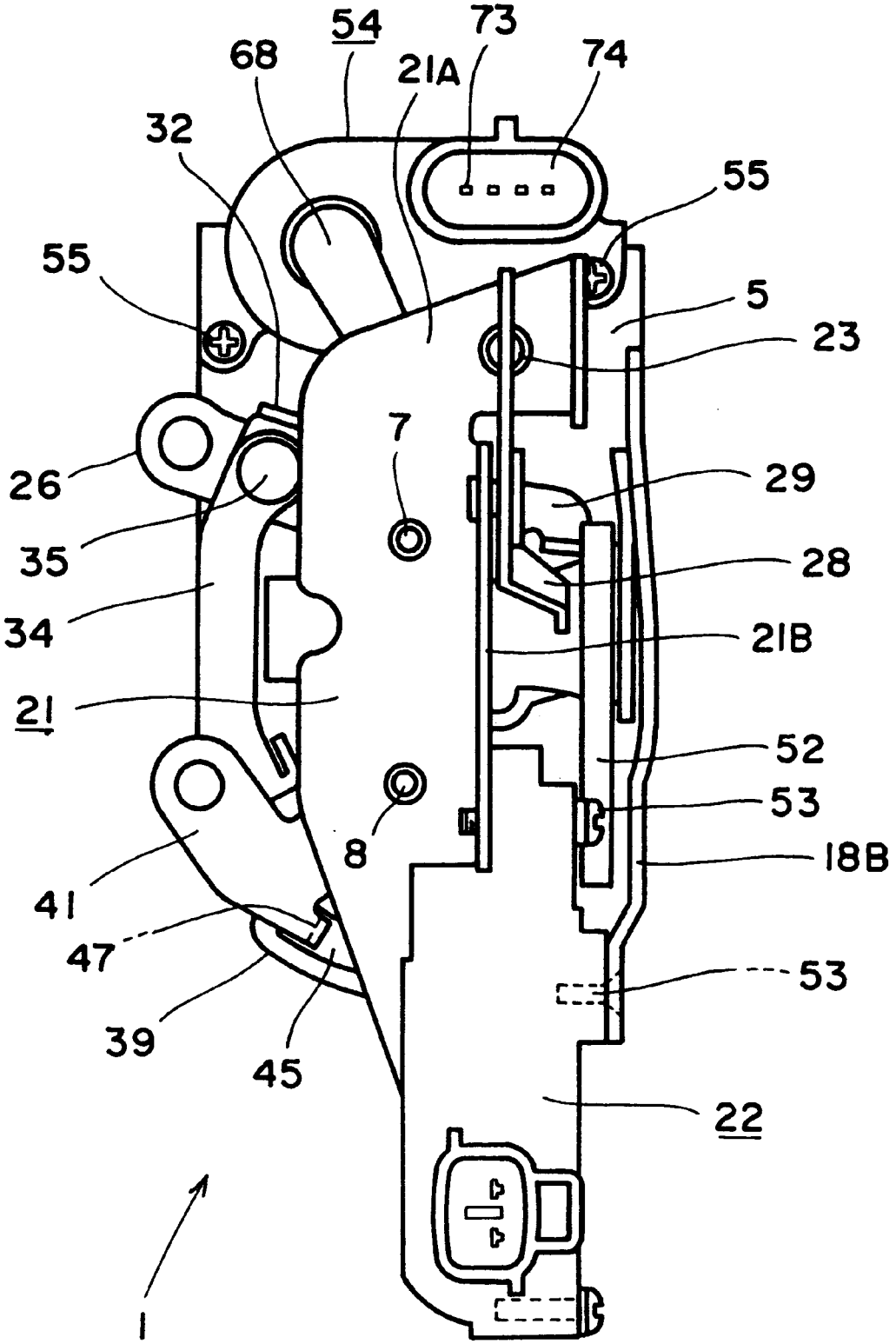
FIG. 5 is a back view of the latch assembly.
Figure 21:
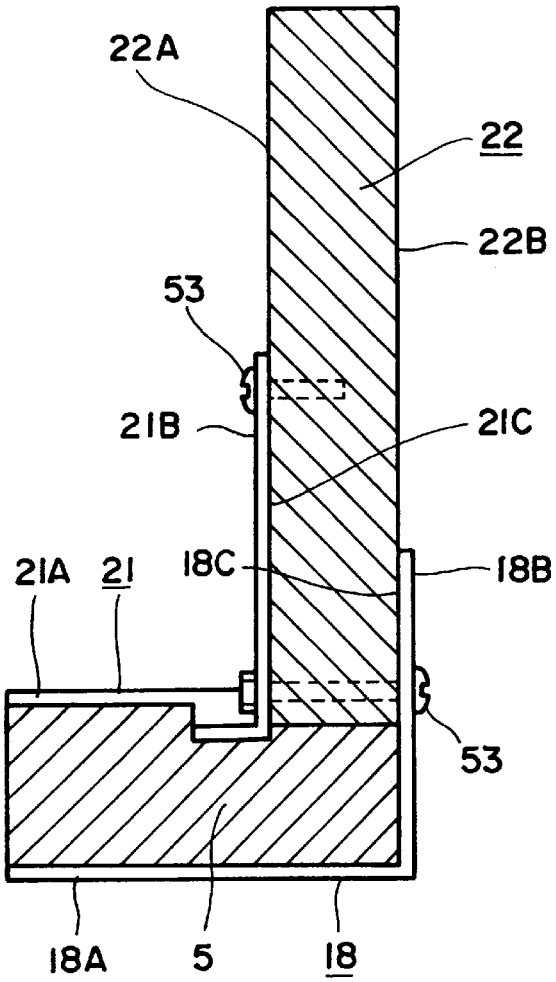
FIGS. 21 and 22 are schematic views showing a state in which the actuator has been installed.
Figure 22:
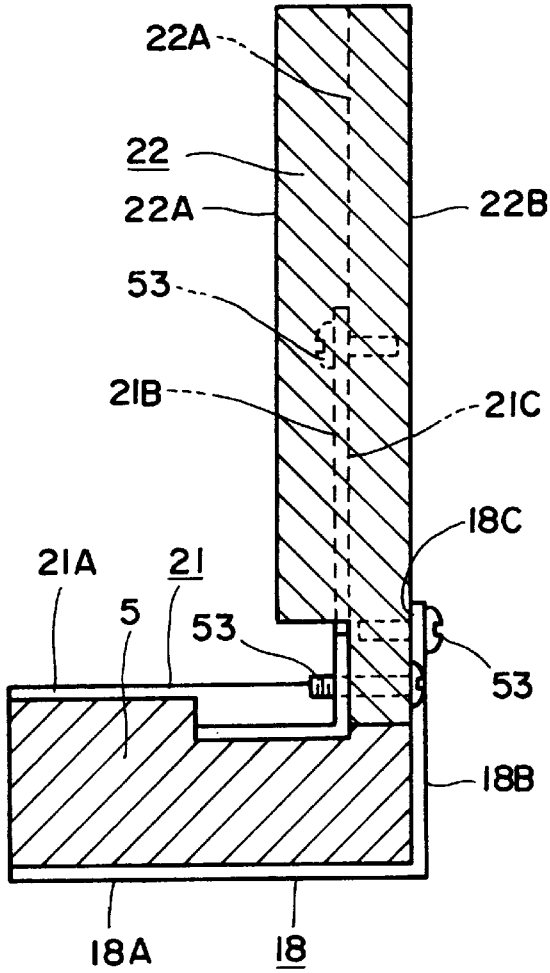

A metal back plate 21 shown in FIGS. 10 to 12 is attached to the rear surface (FIG. 5) of the latch body 5. The back plate 21 consists of a rear plate 21A having a surface substantially parallel to the rear surface of the latch body 5 and an angled plate 21B protruding backward from an interior side edge of the rear plate 21A. As shown in FIGS. 5, 21 and 22, the angled plate 21B is located at a position a little to the exterior side of the latch body 5 in relation to the angled plate 18B of the front plate 18 and is opposed to the angled plate 18B and parallel there to. In the specification of the present invention, therefore, the angled plate 21B of the back plate 21 is often referred to as "exterior angled plate or exterior plate" hereinafter, and the angled plate 18B of the front plate 18 is often referred to as "interior angled plate or interior plate" hereinafter. A motorized lock actuator 22, which will be described later, is fixed between the exterior plate 21B and the interior plate 18B.

The metal plates 18 and 21 are fixed to the latch body 5 using the latch shaft 7 and the ratchet shaft 8, and these three parts 5, 18 and 21 are fixed to a door panel (not shown) using screws 23. The rear plate 21A is fixed to the rear surface of the latch body 5 with a predetermined distance kept therebetween, and is brought into contact with or located adjacent to a horizontal raised portion 24 of the latch body 5 which defines the horizontal passage 11.

Figure 3:
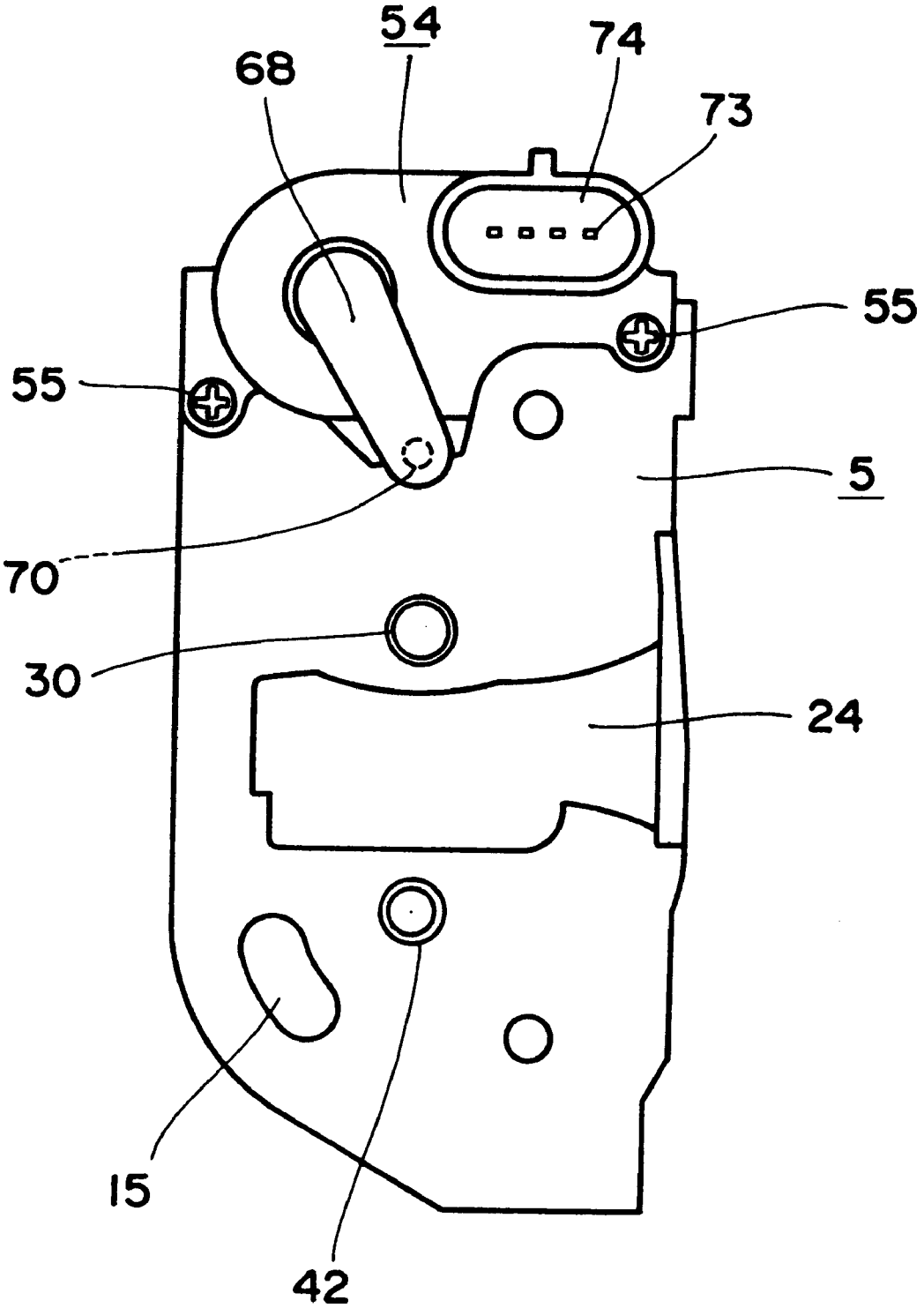
FIG. 3 is a back view showing a state in which a switch box is installed at a latch body of the latch assembly.
Figure 6:
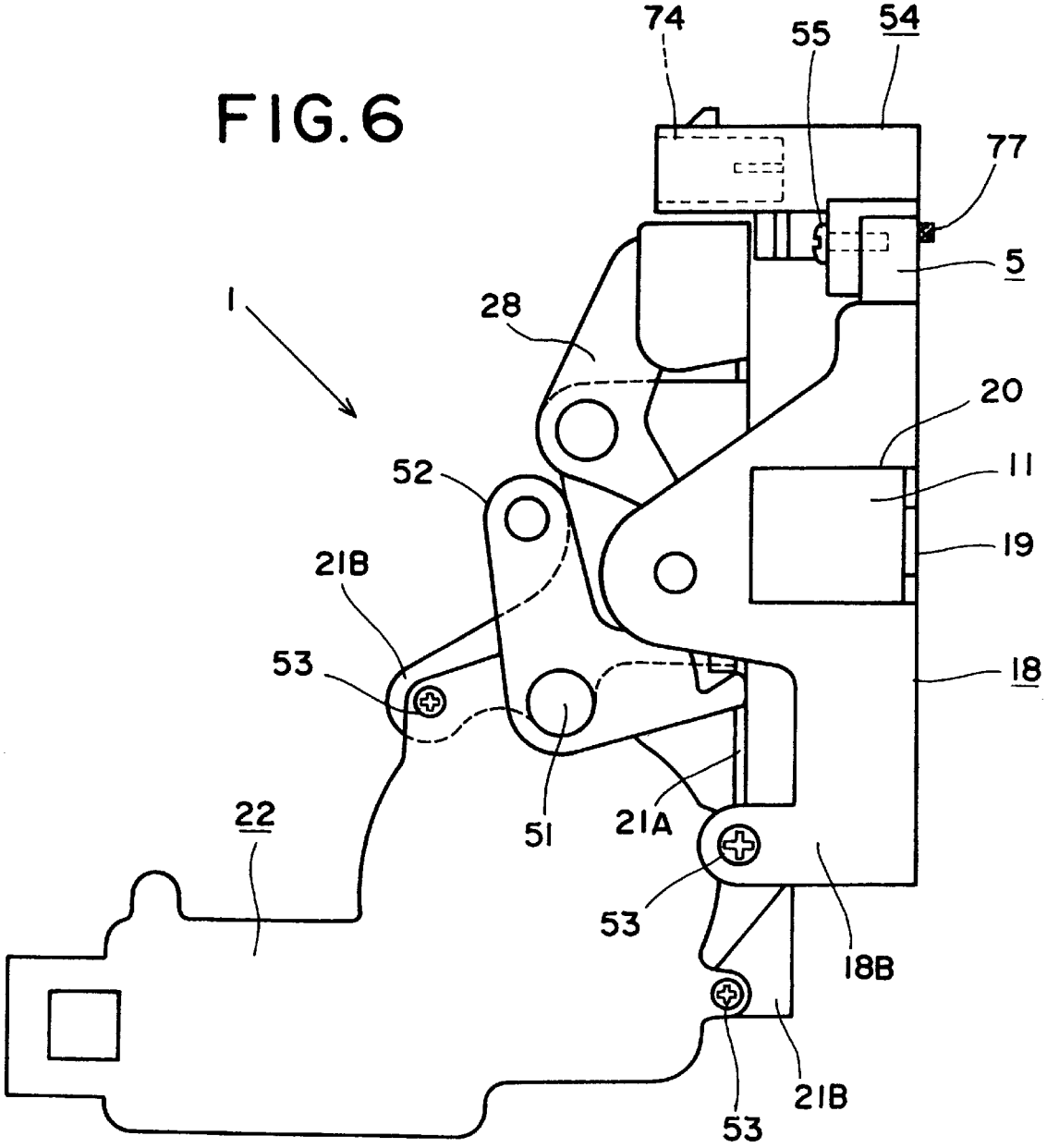
FIG. 6 is a side view showing an interior side of the latch assembly.

Between the latch body 5 and the rear plate 21A of the back plate 21 at a position above the horizontal raised portion 24, an outer open lever 26 (FIGS. 4 and 13) adapted to be coupled to an exterior opening handle 25 of the door and an inner open lever 29 (FIGS. 4 and 14) adapted to be operatively coupled through an intermediate lever 28 (FIGS. 4, 5 and 6) to an interior opening handle 27 of the door are provided. The intermediate lever 28 is rotatably mounted on the exterior angled plate 21B and coupled to the interior opening handle 27 through a rod or wire. The open levers 26 and 29 are rotatably mounted on an outer periphery of a first boss 30 (FIG. 3) into which the latch shaft 7 is inserted. The inner open lever 29 is urged clockwise in FIG. 4 by the elasticity of a return spring 31. The outer open lever 26 has a bent portion 32 engageable with the inner open lever 29. When the exterior opening handle 25 is operated, the bent portion 32 is brought into contact with the inner open lever 29 to rotate it counterclockwise. It is noted that the outer open lever 26 may not be provided if the exterior opening handle 25 is coupled to the inner open lever 29.

An upper end of an open link 34 (FIGS. 4 and 15) is coupled to an end of the inner open lever 29 extending toward the exterior side of the latch body 5 by means of a shaft 35. The open link 34 is located at a position a little to the exterior side of the latch body 5 in relation to the horizontal raised portion 24. A notch 36 is formed in a middle portion of the open link 34. A bent portion 37 extending toward the latch body 5 is formed at an edge of the notch 36.

Figure 23:
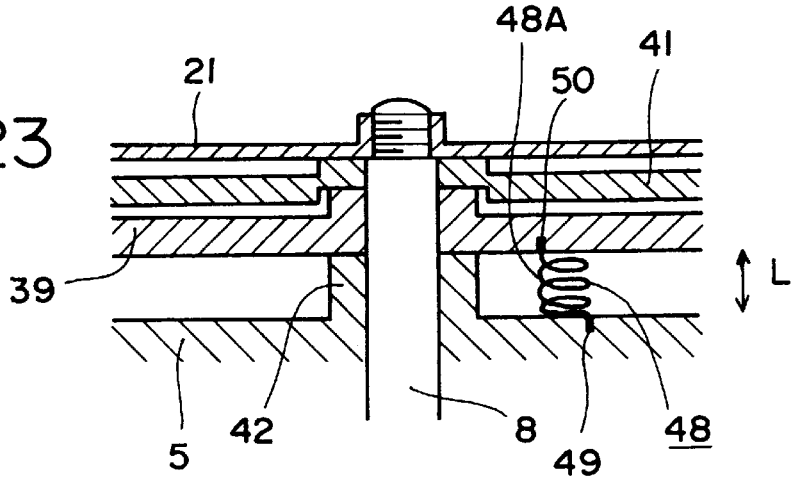
FIG. 23 is a cross-sectional view showing a state in which an over-center spring has been installed.

An inner lock lever 39 (FIGS. 4 and 16) adapted to be coupled to an inside lock button 38 of the door and an outer lock lever 41 (FIGS. 4 and 17) adapted to be coupled to a key cylinder 40 of the door, are provided between the latch body 5 and the rear plate 21A of the back plate 21 at a position below the horizontal raised portion 24. The lock levers 39 and 41 are rotatably mounted on an outer periphery of the ratchet shaft 8. As shown in FIG. 23, the latch body 5 has an integral second boss 42 at the rear surface thereof into which the ratchet shaft 8 is inserted. A predetermined distance L is defined by the second boss 42 between the inner lock lever 39 and the latch body 5. A lower arm 43 of the inner lock lever 39 has a pin 44 and an arc slot 45. The pin 44 is slidably engaged with a slot 46 formed on a lower end of the open link 34, and a protrusion 47 of the outer lock lever 41 is engaged with the arc slot 45 of the inner lock lever 39 with lost-motion.

Figure 4:
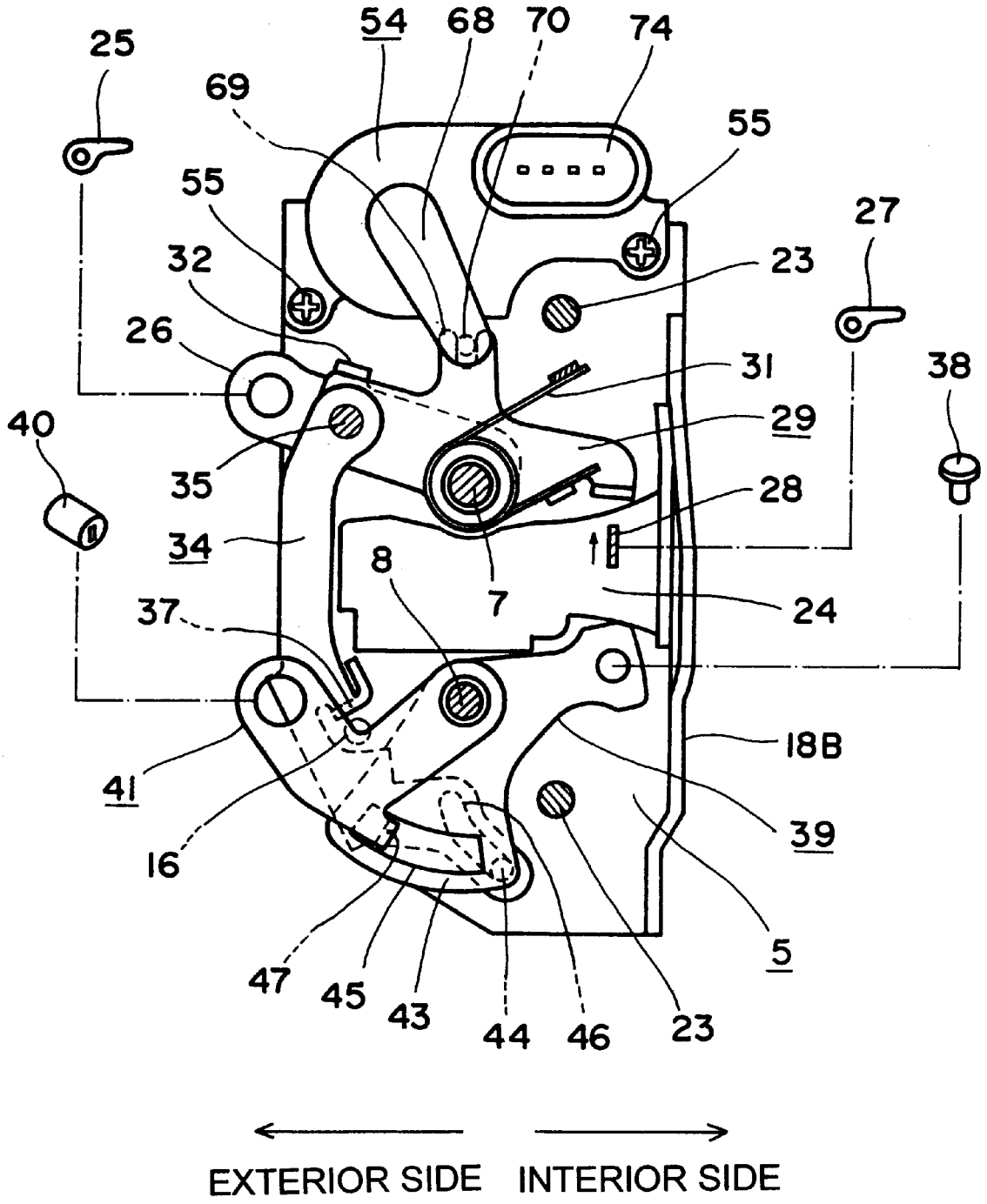
FIG. 4 is a back view showing a state in which a plurality of levers are installed at the latch body.

When the inner lock lever 39 is rotated about the ratchet shaft 8 by the operation of the inside lock button 38, the open link 34 is swung about the shaft 35 and is displaced into an unlocked position or a locked position. The open link 34 shown in FIG. 4 is in the unlocked position and the bent portion 37 of the link 34 is engageably opposed to the ratchet pin 16. Thus, when the open link 34 is moved downward by the rotation of the inner open lever 29, the bent portion 37 is brought into contact with the ratchet pin 16 to move it downward, and the ratchet 4 is then rotated against the elasticity of the ratchet spring 10 and is released from the latch 3, thereby the latch 3 is returned to the unlatched position so as to open the door.

In FIG. 4, when rotating the inner lock lever 39 clockwise using the inside lock button 38, the open link 34 is substantially shifted left and is displaced into the locked position, and then the bent portion 37 is disengageable with the ratchet pin 16. Thus, the downward movement of the open link 34 cannot open the door in the locked state. The inner lock lever 39 is also rotated clockwise through the outer lock lever 41 by the rotational force of the key cylinder 40. The outer lock lever 41 is provided independently of the inner lock lever 39 for purposes of improving the anti-theft capability of the latch device. The outer lock lever 41 may not be provided if the key cylinder 40 is coupled to the inner lock lever 39 with lost-motion.

The inner lock lever 39 is held in one of two over-center positions by the elasticity of an over-center spring 48 (FIG. 23) so as to keep the open link 34 in either the locked position or the unlocked position. The spring 48 has a first leg part 49 engaged with the latch body 5 and a second leg part 50 engaged with the inner lock lever 39. A winding portion 48A of the spring 48 is twisted to the greatest extent when the lock lever 39 comes to a (dead) center position between the two over-center positions. The winding portion 48A has a free height longer than the distance L between the latch body 5 and the inner lock lever 39 in the unloaded condition so that the spring 48 is compressed in a longitudinal direction when it is installed between the latch body 5 and the inner lock lever 39. This over-center spring 48 can also apply an external force in a thrust direction of the ratchet shaft 8 to the inner lock lever 39, thereby preventing the backlash of the inner lock lever 39 in the thrust direction.

Further, the return spring 31 for returning the inner open lever 29 to the initial position can be arranged to have a free height longer than a mounting space between the back plate 21 and the latch body 5 as in the case of the over-center spring 48. This makes it possible to prevent the backlash of the open lever 29 in the thrust direction of the latch shaft 7.

An output lever 52 is fixed to an output shaft 51 of the actuator 22. The output lever 52 is coupled to the inner lock lever 39 so that the lock lever 39 is rotated or displaced by the power of the actuator 22. The actuator 22 is fixed to both the interior angled plate 18B of the front plate 18 and the exterior angled plate 21B of the back plate 21 by a plurality of screws 53. FIG. 21 shows an embodiment in which the thickness of the actuator 22 is set same as the distance between the angled plates 18B and 21B. FIG. 22 shows another embodiment in which the partial thickness of the actuator 22 is set same as the distance between the angled plates 18B and 21B. In either embodiment, an exterior side surface 22A of the actuator 22 is fixed to an interior side surface 21C of the exterior angled plate 21B, whereas an interior side surface 22B of the actuator 22 is fixed to an exterior side surface 18C of the interior angled plate 18B. Compared with the conventional actuator fixed to only a single angled plate of the back plate, the actuator 22 of the present invention which is fixed to the two angled plates 18B and 21B has the increased actuator installation strength. Besides, the both sides of the actuator 22 are fixed to the angled plates 18B, 21B, respectively, so the actuator installation strength of the present invention is further increased. Moreover, the latch assembly 1 of the present invention can be easily be assembled because the angled plate 18B is formed integrally with the front plate 18 which is conventionally used in the latch device, and no reinforcing member independent of the conventional various components of the latch device is used.

A switch box or case 54 made of synthetic resin is fixed to the upper portion of the latch body 5 by screws 55. As shown in FIG. 20, the switch box 54 is installed precisely in a position by fitting protrusions 56 of the switch box 54 into holes 57 of the latch body 5. The switch box 54 has a front side portion 54A for substantially covering the upper side of the latch body 5, and a back side portion 54B positioned backward in relation to the latch body 5. The switch box 54 is assembled into substantially a water-tight state. Two switches, that is, an ajar switch 58 (FIG. 18) for detecting a position of the latch 3 and a handle switch 59 (FIG. 19) for detecting a rotation of the open lever 29 are provided inside of the switch box 54.

A movable terminal 60 of the ajar switch 58 extends in the downward direction from the front side portion 54A of the switch box 54 and protrudes into the recess 6 through a switch passage 61 formed in the latch body 5. The movable terminal 60 and the latch 3 are laid being flush with each other. As shown in FIG. 1, the movable terminal 60 does not come into contact with a small diameter surface 62 of the latch 3 when the latch 3 is in the unlatched position. When the latch 3 is in the full-latched position as shown in FIG. 2, the movable terminal 60 is pushed by a large diameter surface 63 of the latch 3, and the full-latched position of the latch 3 is then detected by the ajar switch 58. Further, when the latch 3 is in the half-latched position, the movable terminal 60 is pushed by a middle diameter surface 64 of the latch 3, and the half-latched position of the latch 3 is then detected by the ajar switch 58. The ajar switch 58 detects these three positions of the latch 3 and transmits a control signal to put on an interior light 65, an ajar warning light 66 and an ignition key light 67 for illuminating the keyway or the key hole of an ignition key cylinder.

A rotating movable terminal 68 of the handle switch 59 is provided in the back side portion 54B of the switch box 54 and is extended substantially in downward direction from the back side portion 54B to overlap with the rear surface of the latch body 5. The rotating movable terminal 68 has a pin 70 engaged with a forked portion 69 of the inner open lever 29. The handle switch 59 detects the rotation of the inner open lever 29 by the operation of the opening handles 25 and 27 and transmits a control signal to activate a door key light 71 for illuminating the keyway or key hole of the door key cylinder 40 and to activate a crime prevention warning buzzer 72. On the back side of the switch box 54 is provided a coupler 74 which has exposed connection terminals 73 electrically coupled to the switches 58 and 59. The switch box 54 with such a structure above allows a rational coupling between the ajar switch 58 and the latch 3 and a rational coupling between the handle switch 59 and the open lever 29. In addition, the two switches 58 and 59 can be installed at the switch box 54 in advance to thereby facilitate assembly operation. Further, since the handle switch 59 can be installed in the waterproof switch box 54, means for providing the handle switch 59 with waterproof is not required.

Figure 24:
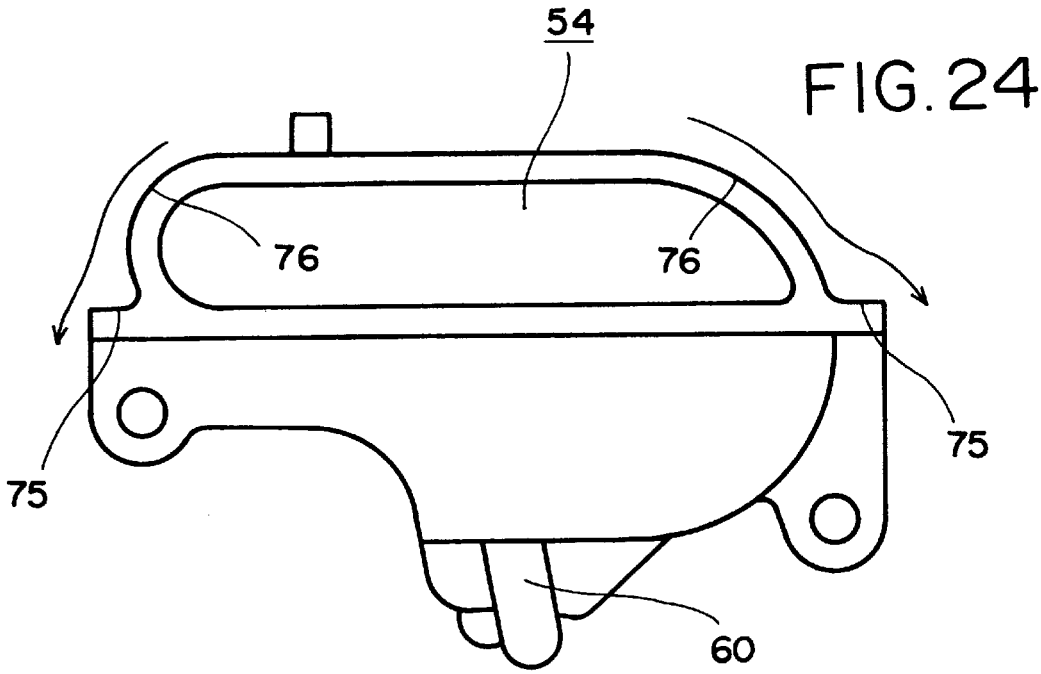
FIG. 24 is an explanatory view showing the function of a flange portion of the switch box.
Figure 25:
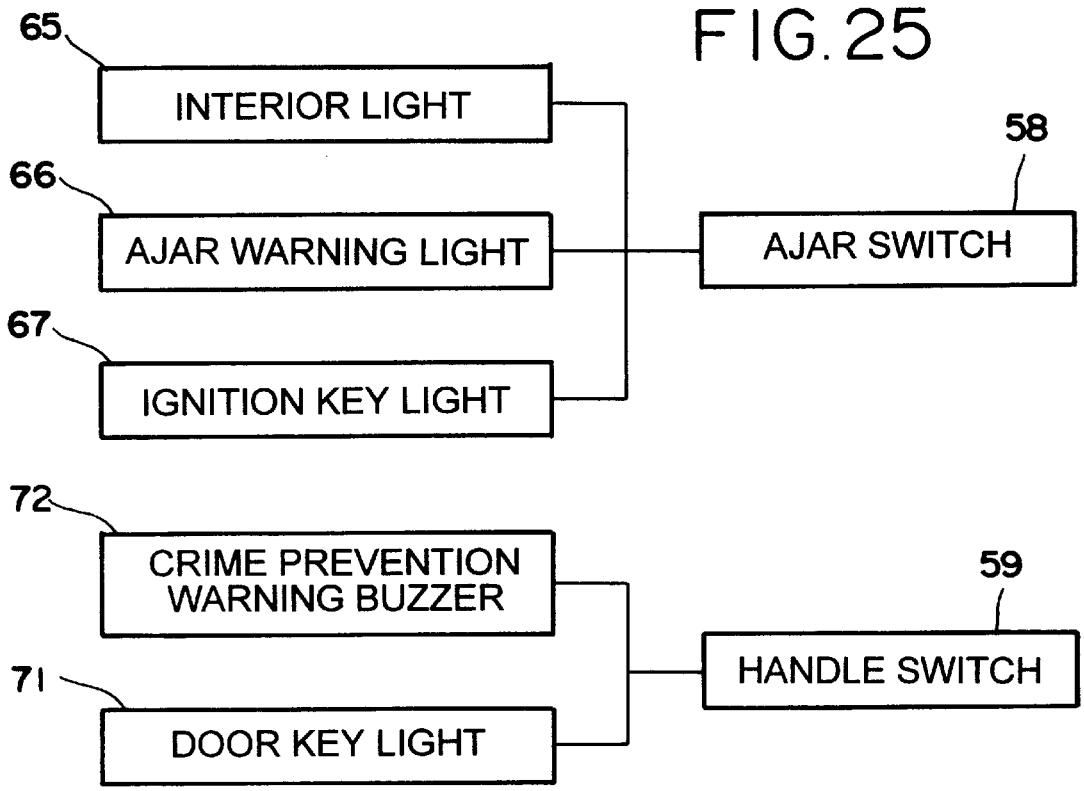
FIG. 25 is a block circuit diagram.

The front side portion 54A of the switch box 59 has inclined portions 76 on the inside and exterior sides thereof and flange portions 75 coupled to the inclined portions 76. The upper side of the latch body 5 is substantially covered by the front side portion 54A provided with the flange portions 75, so that rainwater which enters into the inside space of the door through the gap between a door frame and a door window glass is prevented from directly falling on the latch body 5. As indicated by arrows shown in FIG. 24, the rainwater which falls on the front side portion 54A is directed to the interior side and the exterior side by the inclined portions 76 and the flange portions 75 so as not to enter into the recess 6 the latch body 5, thereby preventing the performance of the latch 3 and the ratchet 4 from deteriorating.

A weather strip 77 is attached to the upper front edge of the front plate 18. When the latch assembly 1 is mounted to the door, the weather strip 77 adheres to the door panel so that the rainwater cannot enter into front side of the latch body 5. The levers provided on the rear side of the latch body 5 are protected by the back side portion 54B of the switch box 54 from the rainwater.

What is claimed is:

1. A vehicle door latch device comprising:

a latch body fixable to a vehicle door and provided at a front side thereof with a recess for accommodating a latch and a ratchet;

a metal front plate fixed to the front side of the latch body;

a metal back plate fixed to a rear side of the latch body, said metal back plate including a rear plate having a surface substantially parallel to a rear surface of the latch body and a first angled plate projecting in a backward direction of the latch body from the rear plate;

a lock lever rotatably mounted on the latch body by a first shaft and adapted to be coupled to an inside lock button of the door; and an actuator fixed to the first angled plate and coupled to the lock lever in order to rotate the lock lever;

wherein said front plate has a cover plate for substantially covering the recess and a second angled plate projecting in the backward direction of the latch body from the cover plate; and wherein said actuator is also fixed to the second angled plate.

2. A vehicle door latch device according to claim 1, wherein at least a part of said actuator is sandwiched between the first angled plate and the second angled plate.

3. A vehicle door latch device according to claim 2, wherein said first angled plate is located at a position to an exterior side of the latch body in relation to the second angled plate, an exterior side surface of said actuator is fixed to an interior side surface of the first angled plate, and an interior side surface of said actuator is fixed to an exterior side surface of the second angled plate.

4. A vehicle door latch device according to claim 1, further comprising an over-center spring provided between the latch body and the lock lever for holding the lock lever in one of two over-center positions, said over-center spring having a free height longer than a length of a space between the latch body and the lock lever so that the over-center spring applies an external force in a thrust direction of the first shaft to the lock lever when mounted between the latch body and the lock lever.

5. A vehicle door latch device according to claim 1, further comprising an open lever rotatably mounted on the latch body by a second shaft and adapted to be coupled to an opening handle of the door; and a return spring for urging the open lever toward an initial position, said return spring having a free height longer than a length of an installation space so that the return spring applies an external force in a thrust direction of the second shaft to the open lever.

6. A vehicle door latch device comprising:

a latch body fixable to a vehicle door and provided with a recess at a front side thereof;

a latch accommodated in the recess and rotatable from an unlatched position to a full-latched position via a half-latched position by engaging with a striker fixed to a vehicle body;

a ratchet rotatably accommodated in the recess for holding the latch in the half-latched position or the full-latched position by engaging with the latch;

an open lever rotatably mounted on a rear side of the latch body by a first shaft and adapted to be coupled to an exterior opening handle of the door for releasing the ratchet from the latch when rotated;

a substantially waterproof switch box fixed to the latch body; and an ajar switch for detecting at least the full-latched position of the latch;

a handle switch for detecting rotation of the open lever;

wherein said ajar switch and said handle switch are accommodated within the switch box;

wherein said switch box has a front side portion overlapping with an upper side of the latch body in a vertical direction of the latch body, and a back side portion located backward in relation to the latch body;

wherein a movable terminal of said ajar switch protrudes from the front side portion toward the latch, and a movable terminal of said handle switch protrudes from the back side portion toward the open lever and is coupled to the open lever.

7. A vehicle door latch device according to claim 6, wherein said front side portion is large enough to substantially cover said upper side of the latch body.

8. A vehicle door latch device according to claim 7, wherein an inclined face is formed on each of an interior side and an exterior side of the front side portion.

9. A vehicle door latch device comprising:

a latch body fixable to a vehicle door and provided with a recess at a front side thereof;

a latch accommodated in the recess and rotatable from an unlatched Position to a full-latched position via a half-latched position by engaging with a striker fixed to a vehicle body;

a ratchet rotatably accommodated in the recess for holding the latch in the half-latched position or the full-latched position by engaging with the latch;

an open lever rotatably mounted on a rear side of the latch body by a first shaft and adapted to be coupled to an exterior opening handle of the door for releasing the ratchet from the latch when rotated;

a substantially waterproof switch box fixed to the latch body;

an ajar switch for detecting at least the full-latched position of the latch;

a handle switch for detecting rotation of the open lever;

said ajar switch and said handle switch being accommodated within the switch box;

a lock lever rotatably mounted on the latch body by a second shaft leaving a space between the lock lever and latch body in a thrust direction of the second shaft and adapted to be coupled to an inside lock button of the door; and an over-center spring provided between the latch body and the lock lever for holding the lock lever in one of two over-center positions;

wherein said over-center spring has a free height longer than a length of said space in said thrust direction so that the over-latched center spring applies an external force in said thrust direction to the lock lever when mounted between the latch body and the lock lever.

10. A vehicle door latch device comprising:

a latch body fixable to a vehicle door and provided with a recess at a front side thereof;

a latch accommodated in the recess and rotatable from an unlatched position to a full-latched position via a half-latched position by engaging with a striker fixed to a vehicle body;

a ratchet rotatable accommodated in the recess for holding the latch in the half-latched Position or the full-latched position by engaging with the latch;

an open lever rotatably mounted on a rear side of the latch body by a first shaft and adapted to be coupled to an exterior opening handle of the door for releasing the ratchet from the latch when rotated;

a substantially waterproof switch box fixed to the latch body;

an ajar switch for detecting at least the full-latched position of the latch;

a handle switch for detecting rotation of the open lever;

said ajar switch and said handle switch being accommodated within the switch box;

a return spring for urging the open lever toward an initial position, wherein said return spring has a free height longer than a length of an installation space between the open lever and the latch body in a thrust direction of the first shaft so that the return spring applies an external force in said thrust direction of the first shaft to the open lever.

11. A vehicle door latch device according to claim 6, wherein said movable terminal of said handle switch is directly coupled to the open lever.

* * * * *